United States Patent [19]

Desom

[11] 4,285,186

[45] Aug. 25, 1981

[54] DEVICE FOR POSITIONING PRINTED CAPS

[76] Inventor: Albert Desom, 5, Route de Stadtbredimus, Remich sur Moselle-Luxemburg, Luxembourg

[21] Appl. No.: 97,636

[22] Filed: Nov. 27, 1979

[30] Foreign Application Priority Data

Dec. 2, 1978 [DE] Fed. Rep. of Germany ..... 2852192

[51] Int. Cl.[3] ..... B65B 57/02; B65B 7/28

[52] U.S. Cl. ..... 53/64; 53/128; 53/290; 53/307; 53/367

[58] Field of Search ..... 53/410, 128, 290, 291, 53/307, 367, 64, 75, 295, 485

[56] References Cited

U.S. PATENT DOCUMENTS 3,422,597 1/1969 Beer ..... 53/307 X 3,523,355 8/1970 Schlapkohl ..... 53/128 X 3,611,662 10/1971 Schmitt ..... 53/367 X

*Primary Examiner*—John Sipos

*Attorney, Agent, or Firm*—Lowe, King, Price & Becker

[57] ABSTRACT

Printed caps to be placed upon filled and corked bottles are forwarded onto slanted parallel guide rods which are caused to selectively rotate to present the successive caps thereon to a cap gripping and setting device with said caps having a determined position as detected by a sensing device disposed adjacent the lower end of the guide rods for sensing marks provided on the caps. The desired position of the caps is determined with respect to a proper positioning of the bottles so as to have printed patterns on the caps and the pleats thereof positioned with respect to structural features of the bottles, such as wire eyes of cork-wiring of champagne bottles.

7 Claims, 2 Drawing Figures

DEVICE FOR POSITIONING PRINTED CAPS

BACKGROUND OF THE INVENTION

The present invention relates to a device for positioning printed bottle caps by means of a device for rotating the caps and of a mark reader, more particularly of the photo-electronic type, to be connected, under control of a switching circuit, to a device for driving or forwarding the bottle caps.

Description of the Prior Art

There is known a device for positioning or directing bottles in a capping machine wherein printed bottle caps of the skirt type are placed in a given position on previously filled and corked bottles, the bottles being afterwards rotated until a photo-electric mark reader detects a mark provided on the cap thus to produce a control pulse for immobilizing the rotating plate carrying the bottle. In such an apparatus, the cap is positioned onto the bottle by causing same to rotate while taking into account the ulterior step of pleating or crinkling the material of the cap, whereby relative positioning of the printed pattern on the cap with respect to the bottle is however not considered.

Such a method presents certain disadvantages more particularly for capping champagne or, more generally, sparkling-wine bottles which are to be equipped with a cork-maintaining cork-wire and which have to be covered with a printed covering cap since it is necessary that the wire eye or ringlet for locking the work-wiring be located only on the side of the bottle neck where folding of the cap will occur.

SUMMARY OF THE INVENTION

The overall object of the present invention is to provide a device for positioning printed bottle caps before they are placed onto the bottles so as to insure ulteriorly convenient pleating of the cap in a desired and convenient position onto the bottle.

In accordance with the present invention, the positioning device comprises at least a pair of separate, parallel slanted guide rod means for forwarding by sliding the bottle caps toward a cap gripping and setting device, at least corresponding portions of said guide rod means being arranged for synchronous rotation around their longitudinal axes, and a mark reader means being arranged adjacent the lower ends of said guide rod means while being directed toward the lowermost cap on said guide rod means for sensing marks provided onto said lowermost cap.

In a preferred embodiment, the guide rod means are unitary and each comprises a peripheral surface showing adherence properties with respect to the material of the cap, for instance due to static rubbing. The slanting angle of the pair of guide rod means is advantageously comprised between about 30° and 40°. Said guide rod means are driven in rotation by the driving shaft of a common driving motor coupled to a braking and coupling device through transmission means such as belts, chains or toothed wheels.

Preferably, several pairs of guide rod means will be arranged one after another for simultaneous positioning and setting of several caps.

Other objects and advantages will become apparent upon consideration of the present disclosure in its entirety.

BRIEF DESCRIPTION OF THE FIGURES OR DRAWINGS

FIG. 1 is a side view of a capping machine incorporating the present invention; and FIG. 2 is a rear view at a greater scale of the guide rod means driving device and of the associated photoelectric mark reader.

DETAILED DESCRIPTION OF A PREFERRED FORM OF THE INVENTION

Figure 1:
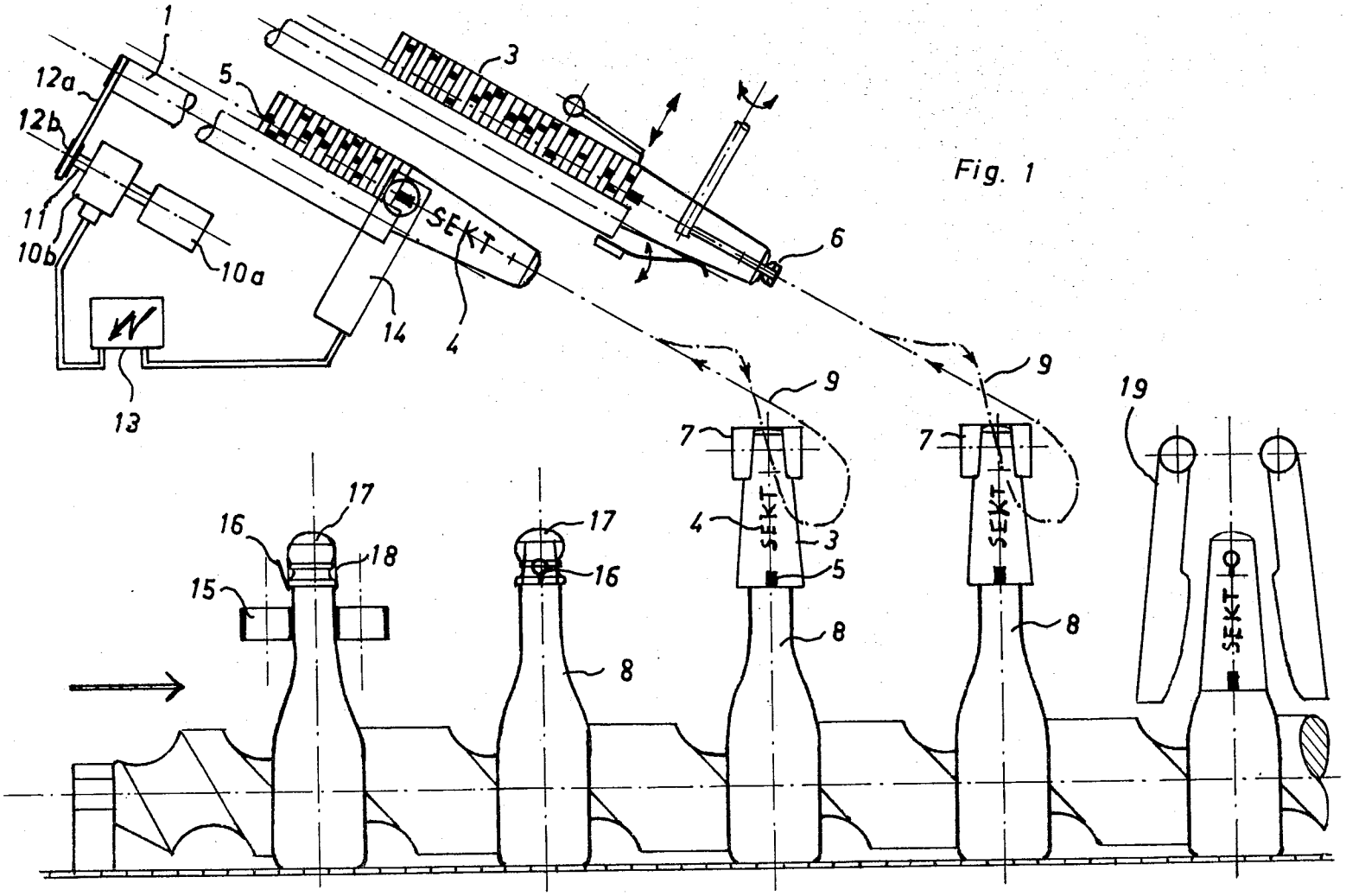

The device for positioning printed bottle caps of the invention comprises a slide means extending at an angle of about 30° with respect to an horizontal plane and comprised by a pair of separate guide rods 1 and 2 extending parallel to each other. Each guide rod is supported for rotation around its longitudinal axis as indicated by the small arrows in FIG. 2. On said guide rods 1 and 2 is disposed a reserve stack of borttle caps 3 which are nested one into each other, each bottle cap being provided with a printed pattern or marking such as 4 and a mark 5. The nested caps slide on the slanted guide rods to come into abutment with a stop 6 adjacent the lower ends of the rods. The lowermost cap on the rods may thus be taken conventionally by a gripping and placing device 7 for being placed, as illustrated by the dash-and-dotted lines 9 in FIG. 1, onto the neck of one of the bottles forwarded continuously below the positioning device by a forwarding device, for instance of the screw-type.

Figure 2:
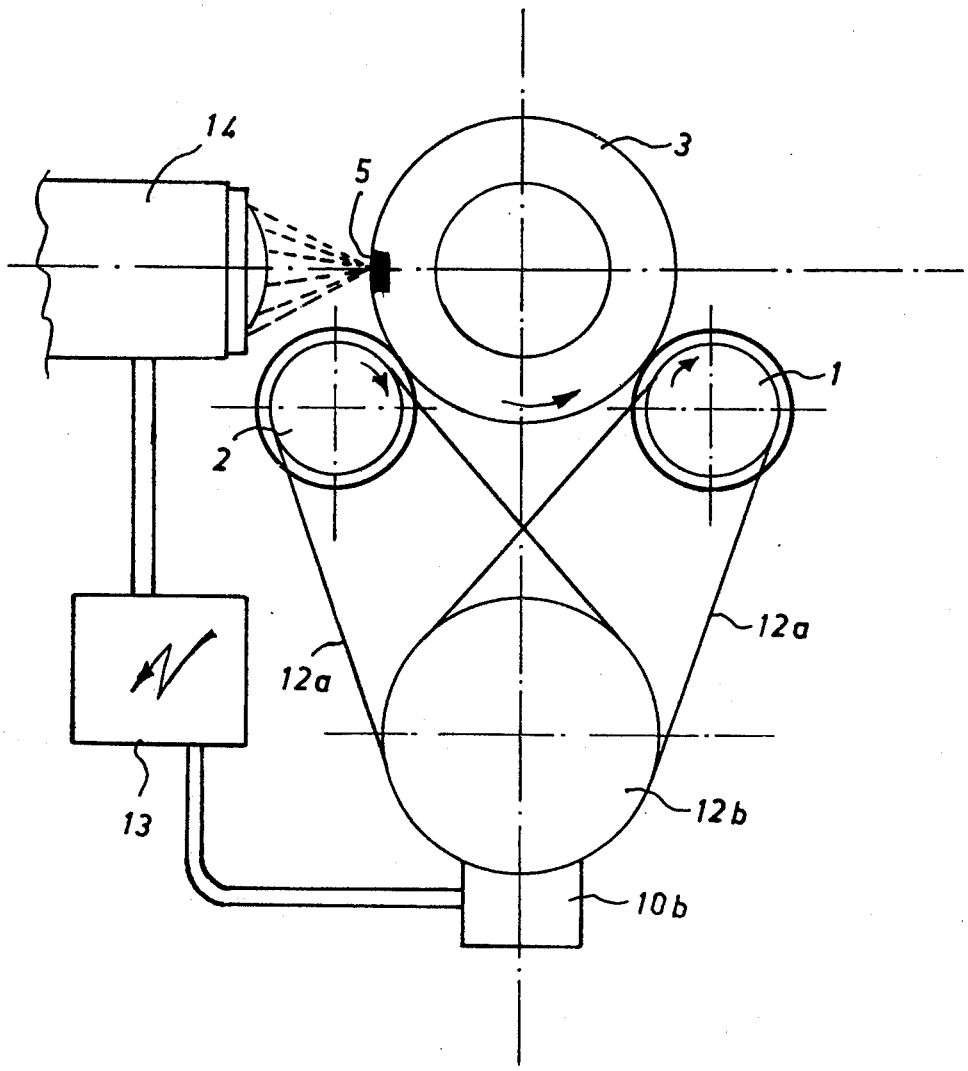

In order to place a cap with the required position or orientation onto a bottle, the stack of nested caps 3 onto te rods 1 and 2 is caused to rotate around its longitudinal axis until the lowermost cap reaches the required position for being grasped by the gripping device. Rotation is imparted to the caps 3 by rotation of the guide rods 1 and 2. Accordingly, the guide rods 1 and 2 are driven by a common driving motor **10*a* associated to a braking and coupling device 10*b*, the driving shaft 11 of the driving motor being kinematically connected to the guide rods 1 and 2 over said braking and coupling device by a transmission system comprising a pair of driving grooved pulleys 12*b* and related belts 12*a*, as shown in FIG. 2. An electric switching circuit 13 selectively controls actuation of the braking coupling device 10*b***.

The switching circuit 13 is connected to a photo-electric mark reader 14 arranged adjacent the lower end of the guide rods so as to sense a mark 5 on the skirt portion of the lowermost cap of the reserve stack 3 in abutment against the stop 6. As soon as the reserve stack of caps 3 has been brought by rotation of guide rods 1 and 2 into a position wherein the mark 5 of the lowermost cap has reached the sensing area of the reader 14, said latterproduces a signal for actuating, through the switching circuit 13, the braking means of the device **10*b* so as to stop the rotation of the guide rods 1 and 2. As soon as the thus oriented lowermost cap has been taken by the gripping device, whereby its mark has left the reading area of the mark reader 14, the driving line between the guide rods and the driving motor is again restored in its operating state to cause the guide rods to rotate till the mark of the following lowermost cap in turn reaches the sensing area of the reader 14**.

In a preferred embodiment, as illustrated in FIG. 1, at least two adjacent cap positioning devices will be provided one after each other in the forwarding direction of the bottles so as to increase the rate of positioning and of setting orientated caps onto the bottles.

As apparent from FIG. 1, the previously filled, corked and corkwired bottles 8 are caused to be displaced along and below the cap positioning device in the longitudinal direction thereof. By means of a bottle positioning or setting device 15 provided upstrem the transmission line, the bottles may be each rotated during their longitudinal displacement so as the wire eye 16 for locking the cork-wiring 18 arranged on the neck and the cork of each bottle may have at the capping station a position corresponding to the desired position or orientation of the printed pattern 4 of the bottle cap which is placed onto the neck of the bottle by the gripping means. The positioning device of the invention is associated in the capping apparatus to a cap pleating device 19 arranged downstream the bottle path in such a manner that pleating of the caps may be achieved with respect to the orientated positioning of the caps onto the bottles so as, according to a preferred embodiment, the locking eye 16 of the cork-wiring be in a position merging or in alignment with the printed pattern 4 of the cap, the fold lines of the cap being formed and crushed substantially symetrically on both sides of said printed pattern of the cap.

While the present invention has been described as embodying specific means, it will be understood that other variations may be adopted without departing from the field and proper scope of the appended claims. For instance, the means for rotating the caps before being taken from the guide means may include rotating end portions of the guide rods in alignment with a prolongating guide means, or by a separate rotating means associated with said rods and intermittently cooperating with the lateral wall of the caps. On the other hand, in lieu of a photo-electronic mark reader, use can be made of any convenient sensing/reading device, for instance of a magnetic type, the configuration and the material of the marks on the caps being selected accordingly.

What is claimed is:

1. A device for orientating and positioning printed container caps to be placed upon containers, said caps being provided with optical marks, said device comprising a cap gripping means, a pair of separated guide rod means extending parallel to each other at an angle to a horizontal plane for slidingly forwarding a stack of interengaged bottle caps supported thereon toward said cap gripping means arranged adjacent the lower end portions of said guide rod means for successively gripping the lowermost cap in the stack and placing same on said container, at least said lower end portions of said guide rod means being mounted for synchronous rotation around their longitudinal axes; a mark reading means arranged adjacent said lower end portions of said guide rod means for sensing the marks provided on the lowermost cap of the stack supported onto said guide rod means; a driving means for selectively rotating said portions of said guide rod means, and a switching means connected to said mark reading means and to said driving means for controlling selective rotation of said portions of said guide rod means, said switching means interrrupting said rotation when a lowermost cap of the stack is in a predetermined rotational position as sensed by said mark reading means.

2. The device of claim 1, for use in a capping machine including bottle forwarding means for forwarding corked bottles along said gripping means, wherein said mark reading means is positioned adjacent said guide rod means in accordance with a separate bottle positioning means provided adjacent said bottle forwarding means upstream of said positioning means with respect to the forwarding direction of said bottles.

3. The device of claim 1, wherein said guide rod means has an outer surface having adherence properties with respect to the material of the caps.

4. The device of claim 1, wherein said guide rod means are inclined at an angle of about 30° to 40° with respect to said horizontal plane.

5. The device of claim 1, wherein said driving means includes a common driving motor, the driving shaft of which is connected to said rotating portions of said guide rod means by a transmission system and a braking and coupling device controlled by said switching circuit for synchroneously driving said rotating portions of said guide rod means.

6. The device of claim 1, for use in a capping machine including bottle forwarding means, which comprises at least two successive pairs of guide rod means arranged one after the other in the forwarding direction of said forwarding means, each pair of guide rod means being associated with one of said mark reading means and one of said cap gripping means.

7. The device of claim 1, wherein said container compises a corked bottle.

* * * * *